United States Patent [19]

Barrash

[11] 4,380,129

[45] Apr. 19, 1983

[54] PROOF-OF-PURCHASE FOR SELF-OPENING CANS

[75] Inventor: Marshall J. Barrash, Atlanta, Ga.

[73] Assignee: The Coca-Cola Company, Atlanta, Ga.

[21] Appl. No.: 300,554

[22] Filed: Sep. 9, 1981

[51] Int. Cl.[3] ..... G09F 3/00

[52] U.S. Cl. ..... 40/307; 220/270

[58] Field of Search ..... 40/310, 312, 5, 306

[56] References Cited

U.S. PATENT DOCUMENTS

| | | | |
|---|---|---|---|
| 2,934,843 | 5/1960 | Henchert | 40/307 |
| 3,190,485 | 6/1965 | D'Andrea | 220/270 |
| 3,822,496 | 7/1974 | Minder | 40/307 |
| 3,958,354 | 5/1976 | Hough et al. | 40/307 |
| 4,171,085 | 10/1979 | Doty | 40/307 |
| 4,203,240 | 5/1980 | Goodwin | 40/310 |
| 4,322,016 | 3/1982 | Barrash | 220/270 |
| 4,344,545 | 8/1982 | Aschberger | 220/270 |

*Primary Examiner*—Gene Mancene
*Assistant Examiner*—Wenceslao J. Contreras
*Attorney, Agent, or Firm*—Birch, Stewart, Kolasch & Birch

[57] ABSTRACT

A novel proof-of-purchase configuration for a pull ring, lever style opening device is disclosed for both a detachable and non-detachable self-opening can lid.

16 Claims, 2 Drawing Figures

PROOF-OF-PURCHASE FOR SELF-OPENING CANS

BACKGROUND OF THE INVENTION

The present invention relates to a proof-of-purchase arrangement for self-opening cans and more specifically to a method for fabricating a ring type, lever arm opening device for self-opening cans associated with non-detachable opening devices on can lids. The opening device is provided with a section which defines a site for communicating desired information.

In self-opening cans in which a lever arm style non-detachable or detachable opening device is provided, the basic concept common to these devices is that a lever arm is lifted to either break through a scored circular or oblong opening area or to completely remove a scored circular or oblong area so as to provide access to the interior of the can. This opening action is completed when the lever arm is lifted from the horizontal position to a vertical or slightly beyond the vertical position in the case of the non-detachable system or, completely stripped from the lid of the can in the case of the detachable system. With companies engaged in promotional activities requiring proof-of-purchase of cans containing liquid beverages it is necessary that the presently designed lever arm style opening devices provide a practical means for demonstrating proof-of-purchase short of retention of the lever arm mechanism itself on that portion of the lid removed during the opening of the container. The use of the detached portion of the lid or lever arm is inherently undesirable and unattractive to the consumer as a means for demonstrating the proof-of-purchase, when necessary or desirable. In the instance where the lever arm is of the non-detachable variety, the arm itself is rivited to the can lid and is difficult to remove by the consumer if such is necessary in order to provide proof-of-purchase. In the case of the detachable lever arm device, the consumer is faced with the undesirable option of handling a rather large strip of metallic material which generally will have sharp edges thus exposing the consumer to potential injury. Thus, it is not expected that such an approach would be considered attractive to the common consumer.

SUMMARY OF THE INVENTION

It is therefore, an object of the present invention to provide a proof-of-purchase technique which will overcome the above noted disadvantages.

It is another object of the present invention to provide a new and novel proof-of-purchase configuration for a lever arm opener for self-opening cans applicable to both the detachable and non-detachable ring pull opening devices.

Another object of the present invention is to provide a method for preparing a ring pull lever arm opening device for a beverage can wherein the proof-of-purchase element is an integral but removable part of the opening mechanism.

Yet, still another object of the present invention is to provide a ring type, lever arm opening device of the detachable and non-detachable variety for a can which includes proof-of-purchase and/or gaming information or other memorabilia on the underside of the opening device.

Still, a further object of the present invention is to provide a self-opening can configuration wherein the proof-of-purchase or other such information to be conveyed to the consumer is affixed to the opening means in such a way that it is readily separated from the opening means and practically suited for communicating information.

A further object of the present invention is to provide a means for proving the purchase of a beverage-containing can which can be safely handled and transmitted without exposing the consumer to potential injury.

These and other objects of the present invention will become more fully apparent with reference to the following specification and drawings which sets forth certain preferred embodiments of the present invention, but it is not intended that the invention be limited thereto.

The foregoing objects and others are accomplished in accordance with the present invention, generally speaking, by providing a ring pull, lever-arm type opening device for a standard beverage-containing can. The material which forms the area within the center of the ring of the pull device is partially cut so as to be hinged at that portion adjacent to the site at which the lever-arm is subsequently to be fixed to the lid of the can. The information to be conveyed is embossed, printed or applied by any other suitable means to the underside of this hinged or cut out portion or tab and during the process of preparation folded or rolled under such that the affixed information is now shielded by the pull device and out of view of the consumer. The information is applied to the underside of the cut out portion or tab of the pull ring prior to riveting the respective member to the lid of the can in such a way so as to create the lever arm or pivotal configuration. In the formation of the ring pull lever arm type of an opener for self-opening can, the lever arm sheet metal stock is fed into a press where the lever arm is formed from a series of suitable reciprocating dies and the center portion of the pull device cut in such a manner that it can be subsequently folded or rolled on the remaining portion adjacent to the fulcrum point of the lever arm so as to create a hinged opening in the ring. The opening device is riveted at a corresponding riveting station where it is attached to a preformed can lid. In the present invention, additional stations are provided between the outlet of the forming dies and the riveting station at which the information desired is embossed, printed or otherwise applied to the underside of the material of the center portion of the ring pull device followed by rolling or folding the cut out portion in such a manner so as to obscure the printed information from view while the can is in a closed state. This operation will be better understood when considered together with the discussion below relating to the illustrations. Thus, the present invention provides a ring type opening device for a can of both the detachable and non-detachable variety with a ready means for indicating proof-of-purchase or other information which may be related to a promotional activity dealing with a game or other consumer participating events. Access to proof-of-purchase tab can be gained by the consumer or user of the canned product only after the lever arm has been elevated to the can opening position. The tab is easily removable and transferable by the consumer. Alternatively, so as to protect the user from potential injury, the edges of the cut out portion of the pull ring are scored in such a manner so as to blunt the edges and thereby eliminat any sharpness which might result during fabrication.

DETAILED DESCRIPTION

Figure 1:
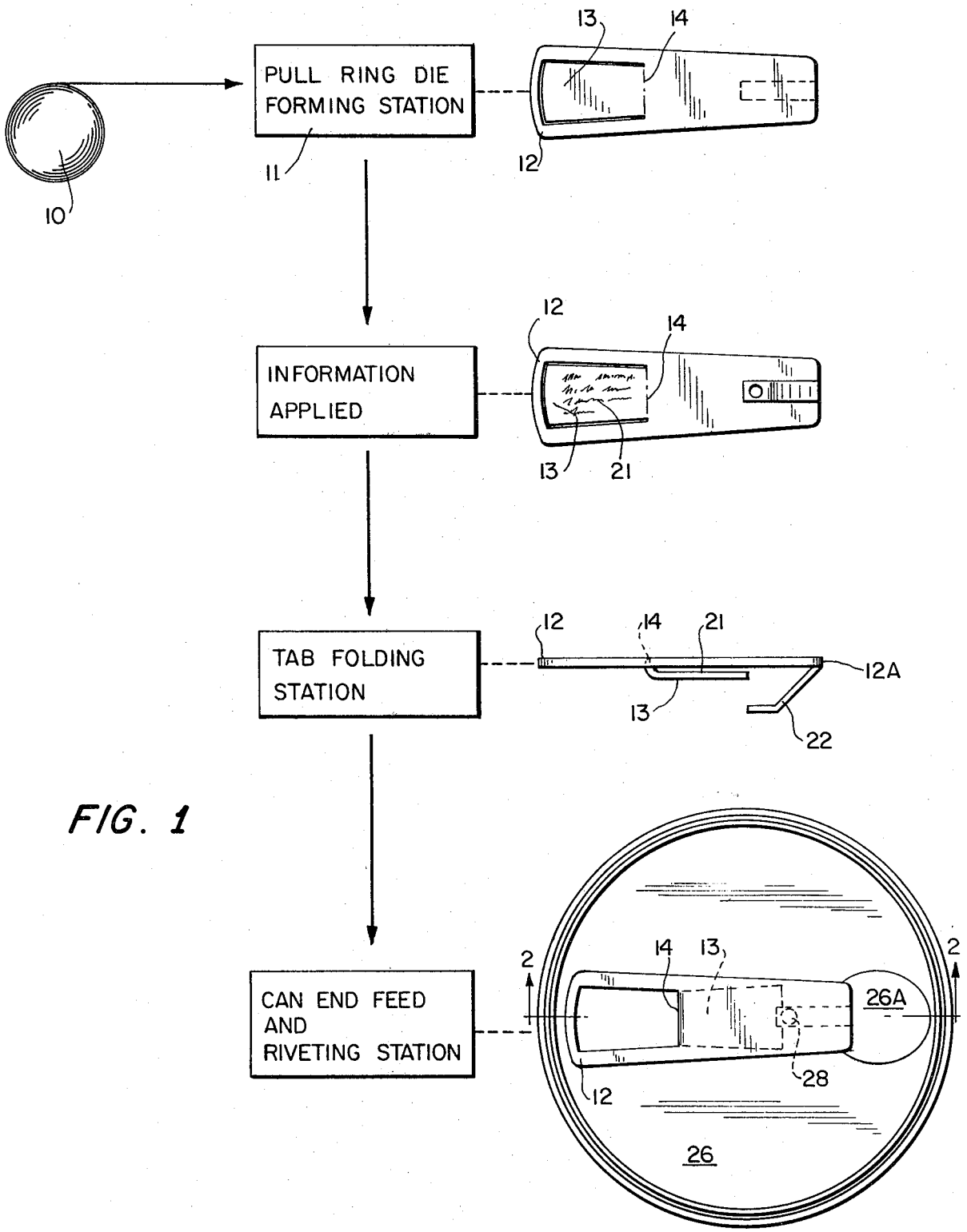
FIG. 1 illustrates the four stage operation for preparing the ring type lever arm opening device of the present invention.

Referring now to FIG. 1, there is seen in stages the process or method for preparing the lever arm type ring pull opening device for a beverage can of the present invention. In the first stage, a roll of stock material 10 from which the lever arm type opening device is fabricated is fed into a die forming station designated 11 to produce the ring type pull device having a finger engageable lever actuating arm 12, the center portion of which 13 is cut in such a way so as to produce the perforated edge 14. The opening device is next fed to the second station 20 at which the information 21 is applied to the underside of the cut out portion or tab 13. The relevant information is embossed, stamped, printed, or otherwise applied to the respective surface of the cut out portion of the pull ring.

The embossed pull ring is next fed to a third stage or station at which the cut out portion 13 of the pull ring is folded or rolled under on the perforated edge 14 such that the information 21 affixed thereto at the previous station is now obscured from view. Simultaneously therewith the respective edges of the cut out portion are dulled or otherwise scored so as to eliminte any sharpness on the respective edges.

The resulting pull type lever arm opening device including proof-of-purchase tab is next fed to a can end feeding and riveting station whereat the lever arm extension 22 is fixed to the can such that the tab 13 is between the lever arm 12 and the can end blank 26 which can end blank includes a prescored area 26A adjacent to which the lever arm 12 is to be riveted at extension 22. The lever arm 12 is riveted by a means of a rivet 28 through the top of the can end 26 such that the rivet 28 provides a fulcrum in a manner known in the art about which the opening tip 12A of the lever arm pivots to engage the prescored opening area 26A of the can and cause it to rupture and open the can and to provide access thereto in a non-detachable configuration. Alternatively, the pull ring can be completely removed along with the perforated area in a detachable system (not shown). In either case, the proof-of-purchase tab now becomes accessible to the consumer when the pull ring is lifted to its opened position.

As can be seen from the illustrations, the proof-of-purchase tab 13 which can exhibit any type of information desired, such as for game playing or other use is completely obscured from access until such time as the can end with which it is associated is opened by the associated lever arm action of the pull ring. Once the can is opened by raising or pivoting the lever arm 12 about the rivet 28, the information bearing tab 13 can be readily removed or separated from the lever arm for redemption or other useful purpose.

Figure 2:
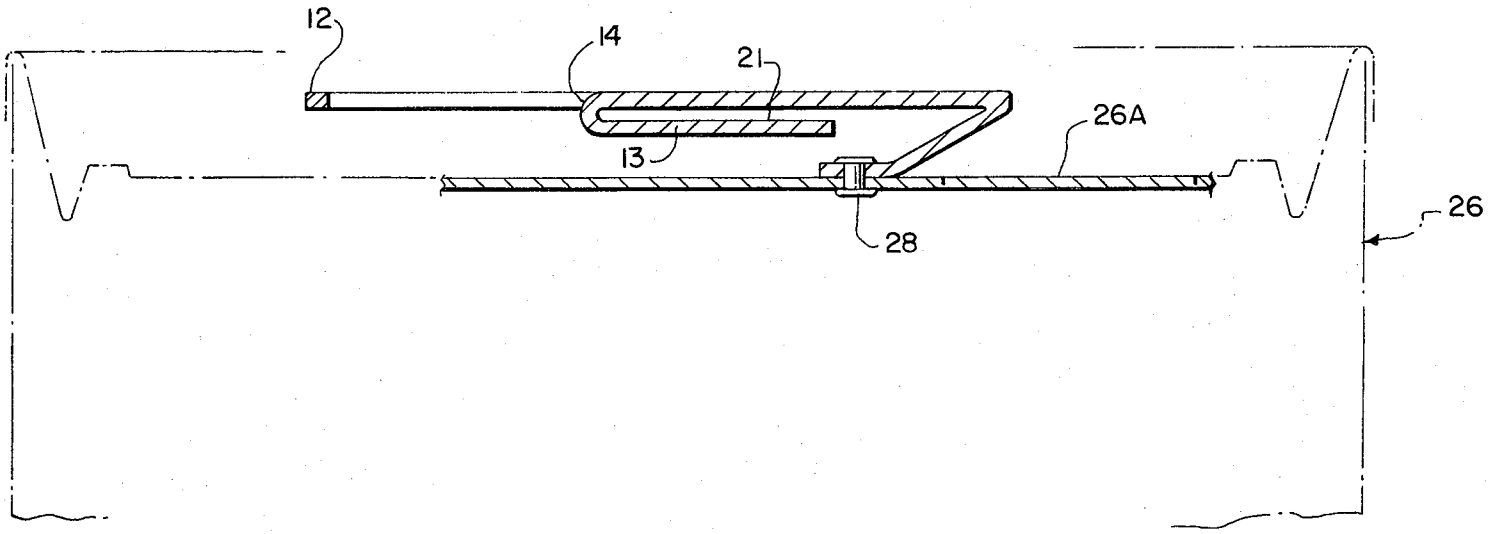
FIG. 2 is a cross section of the finished product of the opening device taken along line 2—2 of the fourth stage of FIG. 1.

Referring now to FIG. 2, there is seen the can end 26 with the lever arm opening device 12 riveted thereto by the rivet 28. The proof of purchase tab 13 is represented in its final folded-back position, hinged to the lever arm 12 at its perforated edge 14. The opening end or tip 12A (FIG. 1) of the lever arm can be pivoted to engage the prescored opening area 26A of the can end 26. The proof-of-purchase or other information 21 is embossed or printed on the underside of the tab 13. Thus, it is readily apparent that the information so applied is obscured from the view of the user until such time as the lever arm 12 is raised and the tab 13 can be removed from the pull ring lever arm by bending the tab away from the lever arm about the perforated edge 14. The tab will readily snap along the edge of the perforation.

Thus, the present invention provides an extremely effective approach for providing proof-of-purchase or other promotional messages on self-opening beverage containing cans to be used with conventional ring type lever arm self-opening devices.

The invention being thus described, it will be obvious that the same may be varied in many ways and those skilled in the art will have other modifications occur to them based on the teachings of the present invention. These modifications are intended to be encompassed within the scope of the following claims.

I claim:

1. A pull ring opening device for a self-opening can lid comprising:

a finger engaging portion;

a closure engaging portion for engaging closure means for said can; and an integral removable portion comprising at least a surface adapted to display indicia.

2. A pull ring opening device as in claim 1, wherein said integral removable portion comprises an integral tab which is removable from said pull ring device along a score line.

3. A pull ring opening device as in claim 2, wherein, said finger engaging portion comprises a loop for engaging the finger of a user of said opening device; and said tab is removably connected to said pull ring device adjacent said loop.

4. A pull ring opening device as in claim 1, wherein said surface of said removable portion is juxtaposed with another portion of said pull ring device whereby said surface is not open to view when said removable portion is connected to said pull ring device.

5. A pull ring opening device as in claim 4, wherein said another portion is located substantially between said finger engaging portion and said closure engaging portion.

6. A pull ring opening device as in claim 1, further comprising means for affixing said pull ring device to the surface of said can lid.

7. A pull ring opening device as in claim 1, wherein said removable portion is positioned adjacent a portion of said pull ring device which lies adjacent said can lid when said pull ring device is associated with said lid, whereby said removable portion is not open to view when said pull ring device is associated with said lid.

8. A can end assembly for self-opening cans, comprising:

a can end having a prescored opening area; and a pull ring opening device associated with said can end adjacent said prescored area, said pull ring opening device comprising an integral tab removable therefrom, said tab being positioned between said device and said can end.

9. A can end assembly as in claim 8, wherein, said pull ring device comprises a finger engaging portion and a portion for engaging said prescored area; and said tab is positioned substantially between said portions.

10. A can end assembly as in claim 8, wherein said pull ring opening device is non-detachably affixed to said can end.

11. A can end assembly as in claim 8, wherein said tab comprises a surface adapted to display indicia.

12. A can end assembly as in claim 8, wherein said tab is not open to view when said pull ring device is associated with said can end;

further comprising indicia associated with said tab.

13. A can end assembly as in claim 8, wherein said tab comprises a surface which is not open to view when said tab is connected to said pull ring device;

further comprising indicia associated with said surface.

14. A method for manufacturing a self-opening can end assembly having a prescored closure area, comprising:

providing an integral pull ring device having a finger engaging portion, a closure engaging portion, and a removable portion;

applying indicia to said removable portion; and affixing said pull ring device to said can end.

15. A method as in claim 14, further comprising the step of positioning said removable portion prior to affixing said pull ring device to said can end in a manner such that said indicia are not open to view.

16. A method as in claim 14, wherein said pull ring device is affixed to said can end adjacent said prescored area.

* * * * *